United States Patent [19]

Gryctko

[11] 3,987,540

[45] Oct. 26, 1976

[54] METHOD OF FORMING A CRIMP-TYPE ELECTRICAL CONNECTOR

[75] Inventor: Carl E. Gryctko, Haddon Heights, N.J.

[73] Assignee: I-T-E Imperial Corporation, Spring House, Pa.

[22] Filed: Mar. 4, 1975

[21] Appl. No.: 555,165

Related U.S. Application Data

[63] Continuation-in-part of Ser. No. 420,432, Nov. 30, 1973, abandoned.

[52] U.S. Cl. ..... 29/630 A; 29/628; 174/84 C; 174/90; 403/275

[51] Int. Cl.[2] ..... H01R 43/04

[58] Field of Search ..... 339/276, 277; 29/630 R, 29/630 A, 628, 629; 174/84 C, 90, 94 R; 403/275, 279, 282, 283

[56] References Cited

UNITED STATES PATENTS

| | | | |
|---|---|---|---|
| 1,702,756 | 2/1929 | Woodbridge | 29/630 A X |
| 2,247,041 | 6/1941 | Bergan | 29/630 A |
| 2,251,176 | 7/1941 | Temple | 339/277 R |
| 2,935,551 | 5/1960 | Wells | 29/630 A |

FOREIGN PATENTS OR APPLICATIONS

| | | | |
|---|---|---|---|
| 840,629 | 6/1939 | France | 339/276 S |
| 747,671 | 4/1956 | United Kingdom | 339/276 T |
| 778,454 | 7/1957 | United Kingdom | 339/276 T |

*Primary Examiner*—C.W. Lanham
*Assistant Examiner*—James R. Duzan
*Attorney, Agent, or Firm*—Ostrolenk, Faber, Gerb & Soffen

[57] ABSTRACT

An electrical connector is constructed by inserting the end of a stranded cable into a loosely fitted sleeve having diametrically opposed apertures. Thereafter, the sleeve is crimped for securement thereof to the cable. The crimping tool is provided with a punch section that moves through the sleeve apertures and in so doing pierces the cable by spreading the strands thereof, thereby forming a through passage for insertion of a mounting bolt that will be received by a threaded aperture in a terminal. During the crimping operation the sleeve is formed with an extensive flat surface area that will be in intimate contact with the terminal.

3 Claims, 10 Drawing Figures

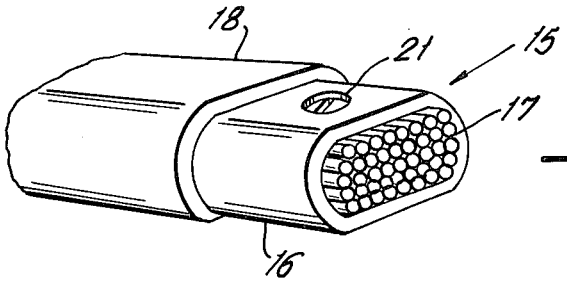
FIG. 1
FIG. 2
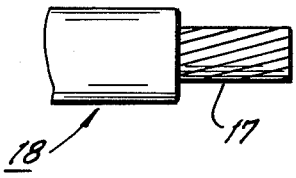
FIG. 3
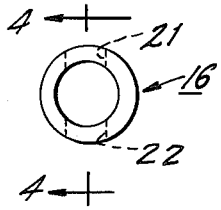
FIG. 4
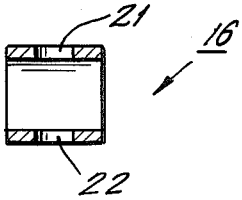
FIG. 5
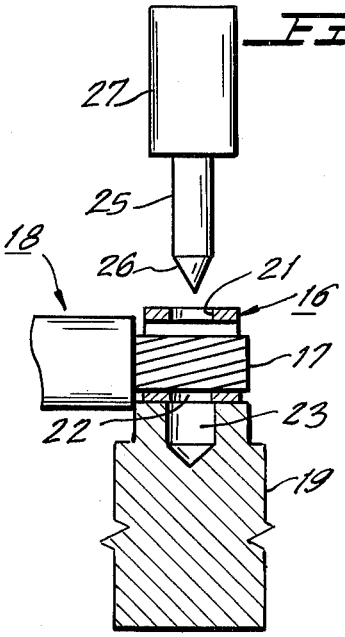
FIG. 6
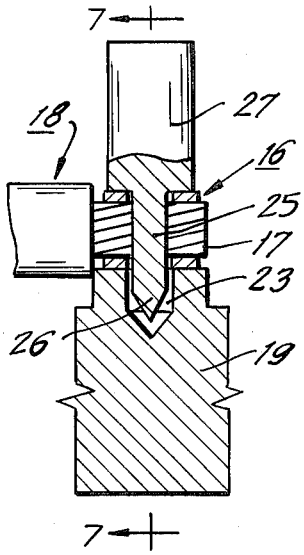
FIG. 7
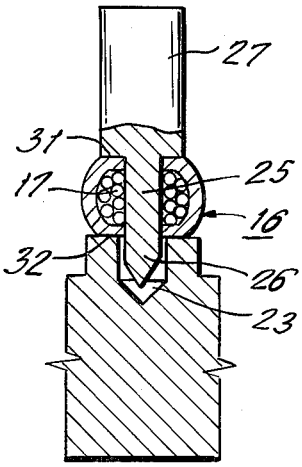
FIG. 8
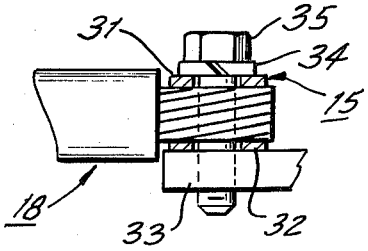
FIG. 9
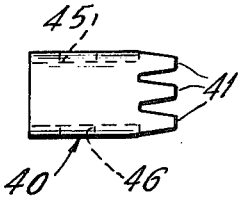
FIG. 10
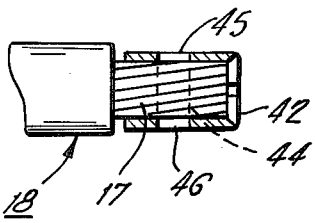

METHOD OF FORMING A CRIMP-TYPE ELECTRICAL CONNECTOR

This application is a continuation-in-part of my copending application Ser. No. 420,432 filed Nov. 30, 1973, now abandoned, relating to electrical connectors in general and more particularly relating to the making of connectors of this type by crimping a sleeve at the end of a stranded cable.

Crimp-type electrical connectors require a relatively large crimping area to provide a low resistance between the crimped element and the cable being connected. These connectors also require that the crimped element have a relatively large flattened portion containing a mounting hole, with this flattened portion being pressed against the electrical terminal to which a connection is being made. Because of these requirements, prior art crimp-type connections are for the most part constructed of a member having a flat portion through which the mounting hole extends and, offset from this flat portion, a sleeve which receives the end of the cable. The flat portion is offset from the crimped portion so that the former is positioned beyond the end of the cable. By offsetting the flat portion from the crimped portion, crimp-type connectors of the prior art have become excessively long, often to the point where they are not suited for making cable connections to molded case circuit breakers. That is, for making line and load connections to many molded case circuit breakers, even a crimp-type connector must fit entirely within the confines of terminal connecting regions provided in the circuit breaker housing for such purpose.

In accordance with the instant invention, the flattened area of the connector with its bolt receiving aperture is in the crimped portion of the connector rather than being offset therefrom. This provides a compact unit that will fit within the limited space available for terminal connections to molded case circuit breakers. An added advantage is that a single tool is utilized to pierce the cable during the crimping operation, and at the same time form the sleeve with flattened contact areas adjacent the bolt holes.

Accordingly, a primary object of the instant invention is to provide a novel crimp-type electrical connector.

Another object is to provide a novel method for constructing a connector of this type.

A further object is to provide a connector of this type that is extremely compact, yet retains all the desirable electrical features of prior art connectors.

These objects as well as other objects of this invention will become readily apparent after reading the following description of the accompanying drawings in which:

FIG. 1 is a perspective of a crimp-type connector constructed in accordance with teachings of the instant invention.

FIG. 2 is a side elevation showing a fragmentary portion of an insulated stranded cable, the end of which has been stripped of insulation.

FIG. 3 is an end view of the connector sleeve prior to crimping.

FIG. 4 is a cross-section taken through line 4—4 of FIG. 3, looking in the direction of arrows 4—4.

FIG. 5 is a cross-section showing the cable of FIG. 2 and sleeve of FIG. 3 assembled together and mounted in a crimping and piercing tool prior to operation of the latter.

FIG. 6 is a view similar to FIG. 5, with the tool shown at the end of its working stroke.

FIG. 7 is a cross-section taken through line 7—7 of FIG. 6, looking in the direction of arrows 7—7.

FIG. 8 is a partially sectioned side elevation showing a crimp-type connector constructed in accordance with the instant invention, secured to a circuit breaker terminal.

FIG. 9 is a side elevation showing a modified sleeve for production of a crimp-type connector.

FIG. 10 is a side elevation, partially sectioned, showing a connector formed by crimp connecting the sleeve of FIG. 9 to the end of a stranded cable.

Now referring to the figures. Crimp-type connector 15 is constructed by connecting conducting sleeve 16 of FIGS. 3 and 4 to stripped end 17 of insulation covered stranded cable 18. This connection is made by inserting cable end 17 into loosely fitted sleeve 16 supported on tool base 19, with diametrically opposed circular apertures 21, 22 of sleeve 16 aligned with recess 23 in the upper surface of base 19 (FIG. 5). Punch-type crimping and piercing tool 25 is then driven downward through sleeve apertures 21, 22, with the pointed lower end 26 of tool 25 entering base recess 23. At the end of this working stroke, when punch 25 reaches its lowermost position of FIG. 6, crimping portion 27 of tool 25 positioned above piercing portion 26 thereof has deformed sleeve 16 so that it assumes the shape seen in FIG. 7, and at the same time a through passage aligned with sleeve apertures 21, 22 has been formed in stripped cable end 17 by the transverse displacement of the cable strands.

The crimping of sleeve 16 provides a secure friction fit against the outer surface of cable end 17. This connection may be made more secure by roughening the interior surface of sleeve 16 prior to the crimping operation. Base 19 and crimping portion 27 of tool 25 are so constructed that the outer surface of sleeve 16 is flat in the regions 31, 32 adjacent the respective apertures 21, 22.

As seen in FIG. 8, crimp-type connector 15 is mounted to circuit breaker terminal strap 33 by placing flattened surface 32 of sleeve 16 on the upper surface of terminal 33 and aligning apertures 21, 22 with a threaded aperture in terminal 33. Bolt 35 with lock washer 34 adjacent the head thereof is inserted through aperture 21, then aligned through passage in stripped cable portion 17, and through aperture 22 into a threaded aperture in terminal 33.

In the embodiment of the instant invention illustrated in FIG. 10, a modified sleeve 40 (FIG. 9) is utilized. Sleeve 40 includes all of the sections of sleeve 16 and in addition includes axially extending ears 41 at one end thereof. During the crimping and punching operation, or even prior thereto, ears 41 are inwardly bent to form lip means 42 adjacent the free end of stripped cable portion 17. Lip means 42 serves to retain any strands of cable 18 that may have been inadvertently severed during formation of through cable passage 44 which is aligned with diametrically opposed apertures 45, 46 in sleeve 40.

Although there have been described preferred embodiments of this novel invention, many variations and modifications will now be apparent to those skilled in the art. Therefore, this invention is to be limited not by the specific disclosure herein but only by the appending claims.

I claim:

1. A process for producing an electrical connector comprising the steps of inserting an unpierced portion of a stranded cable into a loosely fitted sleeve having diametrically opposed apertures through the walls thereof; crimping said sleeve substantially along the entire length of its longitudinal wall until said sleeve is frictionally held to said portion and formed with opposed and generally flat surface portions along substantially the entire length of the longitudinal wall of said sleeve surrounding said diametrically opposed apertures; and piercing said portion by transverse displacement of the strands of said cable to form a through aperture aligned with said diametrically opposed apertures in said sleeve whereby said aperture and said diametrically opposed apertures form a through passage for fastening means to secure the cable and sleeve to an electrical terminal.

2. A process as set forth in claim 1 in which piercing of the portion and crimping of the sleeve occur essentially at the same time.

3. A process as set forth in claim 1 in which the piercing of the portion is essentially completed prior to the crimping of the sleeve.

* * * * *